US006315084B1

(12) United States Patent
Shon

(10) Patent No.: US 6,315,084 B1
(45) Date of Patent: Nov. 13, 2001

(54) APPARATUS FOR REDUCING VIBRATION OF AN ELEVATOR CAR

(75) Inventor: Hye Yeon Shon, Koonpo (KR)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/518,721

(22) Filed: Mar. 3, 2000

(30) Foreign Application Priority Data

Mar. 4, 1999 (KR) ..... 99/7141

(51) Int. Cl.[7] ..... B66B 7/08; B66B 1/28

(52) U.S. Cl. ..... 187/411; 187/292; 187/346; 187/394

(58) Field of Search ..... 187/411, 292, 187/391, 394, 345, 346

(56) References Cited

U.S. PATENT DOCUMENTS

| | | | | |
|---|---|---|---|---|
| 5,181,586 | * | 1/1993 | Yoo et al. | 187/411 |
| 5,289,902 | * | 3/1994 | Fujita | 187/346 |
| 5,641,041 | * | 6/1997 | Masuda et al. | 187/411 X |
| 5,732,740 | * | 3/1998 | Hornyack et al. | 138/26 |
| 5,750,945 | * | 5/1998 | Fuller et al. | 187/292 |
| 5,862,888 | * | 1/1999 | Iwakiri et al. | 187/411 X |
| 6,065,569 | * | 5/2000 | Fuller | 187/411 X |

* cited by examiner

*Primary Examiner*—Janice L. Krizek
*Assistant Examiner*—Thuy V. Tran
(74) *Attorney, Agent, or Firm*—Birch, Stewart, Kolasch & Birch, LLP

(57) ABSTRACT

In the conventional elevator, there arise problems that there is no apparatus capable of reducing only radio-frequency components according to the characteristics of the rubber isolator and dealing with vertical vibration of the entire car, although it is possible to reduce the vibration descending along the rope while passing through the rubber isolator at the lower portion of the car. The present invention relates to an apparatus for reducing vibration of an elevator capable of preventing vibration of the car by installing the dielectric fluid container whose rigidity varies according to the amount of power supply at the connection portion of the thimble rod at which the spring is elastically installed, thereby improving the level of ride comfort by relieving the passengers' unpleasant feelings due to the vibration occurred during the travelling of the elevator, which includes a thimble rod fixedly inserted through a cross head of the elevator car and counter weight, a spring installed at the inserted thimble rod, an dielectric fluid container installed between the cross head and the spring, a driving control unit for detecting the position of the car, a thimble rode control unit for controlling the amount of electric power supplied to the dielectric fluid container according to the position information obtained from the driving control unit, and a power supply unit for supplying the dielectric fluid container with electric power whose amount is controlled by the thimble rod control unit.

2 Claims, 3 Drawing Sheets

APPARATUS FOR REDUCING VIBRATION OF AN ELEVATOR CAR

BACKGROUND OF THE INVENTION

1. Field of the Invention

The present invention relates to an elevator and, in particular, to an apparatus for reducing vibration of an elevator car which makes it possible to reduce vibration of an elevator car for carrying passengers and freight upward and downward in a hoist in a building.

2. Description of the Background Art

FIG. 1 is an explanatory view schematically illustrating a construction of a general elevator, which includes an elevator car 1 which is directly loaded with passengers or mounted with freight and has a rubber isolator installed at a lower side, a driving device 3 which is installed at an upper side of a hoist formed in a building and generates driving force so that the car 1 is driven to be lifted in the hoist 2, a counter weight 4 which is installed at the opposite side of the car 1 and keeps the balance of the weight of the car 1, and a main rope 5 for connecting the car 1 with the counter weight 4 by the driving force generated by the driving device 3.

Herein, the main rope 5 is wound around a lifting sheave 6 installed at the driving device 3 and a pulley 7 installed at an upper side of the counter weight 4 at an interval between them and drives the car 1 in the hoist 2 by winding and unwinding the main rope 5 via the forward rotation and reverse rotation of the lifting sheave 6 by the driving force generated by the driving device 3.

Meanwhile, FIG. 2 is a cross-sectional view illustrating a connection structure of a thimble rod in the conventional art. A thimble rod 9 provided as a single body at the ends of the main rope 5 is connected to the upper portion of the car 1 and counter weight 4. A structure of the thimble rod 9 is as follows.

An insertion hole 11*a* is formed at the upper portion of the car 1 and counter weight 4 and at a cross head 11. The thimble rod 9 having threads formed on the outer circumferential surface thereof is inserted into thorough this insertion hole 11*a*.

Next, a spring 12 is installed at the inserted thimble rod 9. This spring 12 is installed at upper and lower spring seats 13*a* and 13*b* through which the thimble rod 9 passes, and fixedly connected to the car 1 and counter weight 4 by connecting a thread 10 to the outer side of the lower spring seat 13*b*.

The elevator thus constructed drives the driving device 3 by control of a control board (not shown) according to the operating command of an operator to thereby lifting and lowering the elevator car 1.

At this time, when the elevator car 1 is driven to be lifted and lowered, the counter weight 4 connected with the elevator car 1 by the main rope 5 is also driven to be lifted and lowered while keeping the balance of the weight of the elevator car 1.

Herein, during the car 1's traveling by the main rope 5, when the car 1 moves to an upper story, the main rope 5 at the car 1 is shortened and the main rope 5 at the counter weight 4 is lengthened, or when the car 1 moves to an lower story, the reverse is true. Since the main rope 5 is an elastic body, the rigidity thereof is decreased when the length is increased. Thus, in the case that the node of the vertical vibration mode is centered on the lifting sheave 6, when the car 1 is on an upper story, it becomes closer to the counter weight 4, or when the car 1 is on a lower story, it becomes closer to the car 1.

Subsequently, when an exciting force is transferred through the lifting sheave 6, the car 1 get in the vertical vibration mode on upper and lower stories.

However, in the conventional elevator above described, there arise problems that there is no apparatus capable of reducing only radio-frequency components according to the characteristics of the rubber isolator and dealing with vertical vibration of the entire car, although it is possible to reduce the vibration descending along the rope while passing through the rubber isolator at the lower portion of the car.

In particular, there is another problem that since a frequency of the vertical vibration mode affecting the entire car is in a low-frequency area, that is, an area sensitive to axial vibration humans feel, vertical vibration occurred during travelling of the elevator give passengers an unpleasant feeling.

SUMMARY OF THE INVENTION

Accordingly, it is an object of the present invention to provide an apparatus for reducing vibration of an elevator car which removes vibration of a car so that passengers don't feel unpleasant, thereby improving the level of ride comfort.

In order to achieve the above object, there is provided an apparatus for reducing vibration of an elevator car according to the present invention which includes: a thimble rod fixedly inserted through a cross head of the elevator car and counter weight; a spring installed at the inserted thimble rod; an dielectric fluid container installed between the cross head and the spring; a driving control unit for detecting the position of the car; a thimble rode control unit for controlling the amount of electric power supplied to the dielectric fluid container according to the position information obtained from the driving control unit; and a power supply unit for supplying the dielectric fluid container with electric power whose amount is controlled by the thimble rod control unit.

The dielectric fluid container is formed by including electrodes receiving electric power at the upper and lower portions in a rubber tube, and filling the space between the electrodes with dielectric fluid.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiment of the present invention will now be described with reference to the accompanying drawings.

Figure 1:
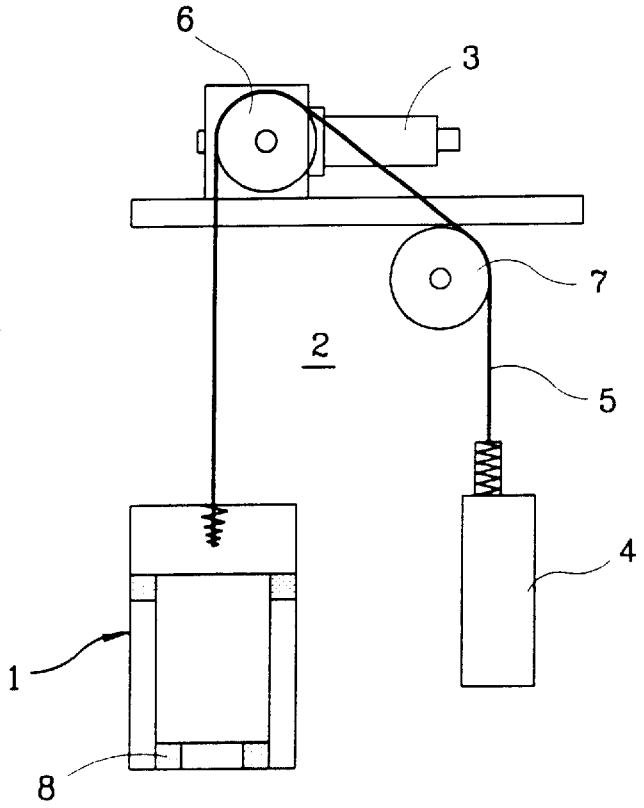
FIG.1 CONVENTIONAL ART
FIG. 1 is a explanatory view schematically illustrating a construction of a general elevator.
Figure 2:
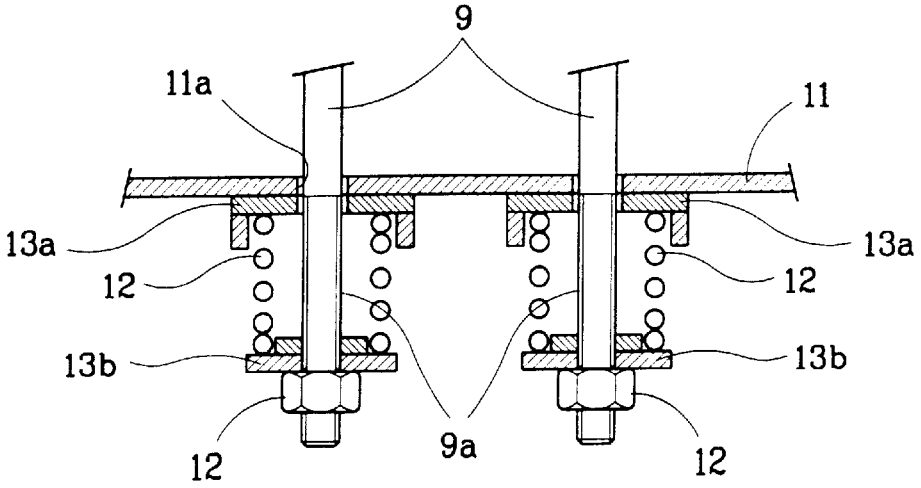
FIG.2 CONVENTIONAL ART
FIG. 2 is a cross-sectional view illustrating a connection structure of a thimble rod in the conventional art.
Figure 3:
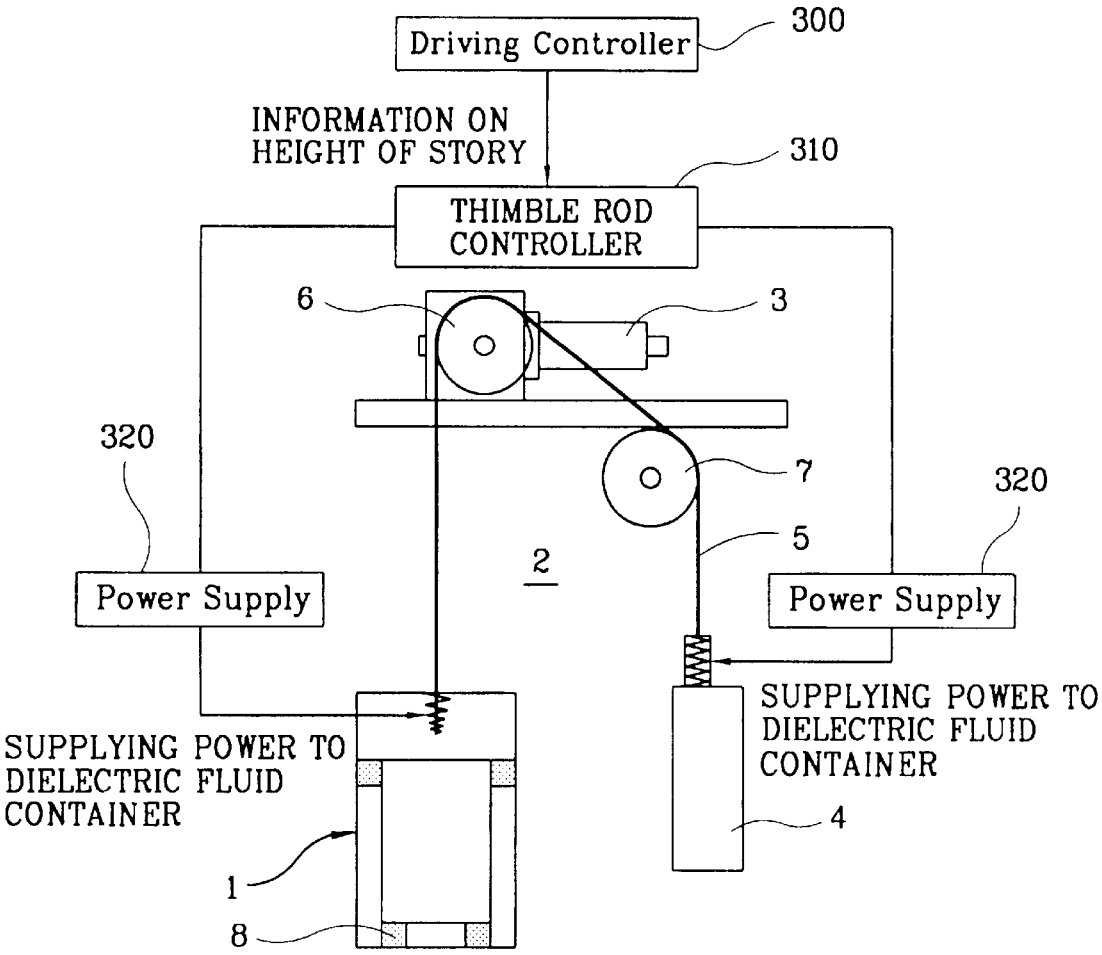
FIG. 3 is an explanatory view schematically illustrating a construction of an elevator in accordance with the present invention.

FIG. 3 is an explanatory view schematically illustrating a construction of an elevator in accordance with the present invention. Elements which have the same function as in the conventional art also have the same reference numerals.

As illustrated therein, an apparatus for reducing vibration of an elevator in accordance with the present invention includes: an elevator car 1 which is directly loaded with passengers or mounted with freight and has a rubber isolator installed at a lower side, a driving device 3 which is installed at an upper side of a hoist formed in a building and generates driving force so that the car 1 is driven to be lifted in the hoist 2, a counter weight 4 which is installed at the opposite side of the car 1 and keeps the balance of the weight of the car 1, a main rope 5 for connecting the car 1 with the counter weight 4 by the driving force generated by the driving device 3; a thimble rod 9 provided as a single body at the ends of the main rope 5 and fixed to the upper portion of the car 1 and counter weight 4; a driving control unit 300 for detecting the position of the car 1; a thimble rod control unit 310 which is installed at the thimble rod 9 according to the position information of the car 1 obtained from the driving control unit 300 and controls the amount of electric power supplied to a dielectric fluid container; and a power supply unit 320 for supplying the dielectric fluid container 200 with electric power according to the signal sent by the thimble rod control unit 310.

Herein, the main rope 5 is wound around a lifting sheave 6 installed at the driving device 3 and a pulley 7 installed at an upper side of the counter weight 4 at an interval between them and drives the car 1 in the hoist 2 by winding and unwinding the main rope 5 via the forward rotation and reverse rotation of the lifting sheave 6 by the driving force generated by the driving device 3.

Figure 4:
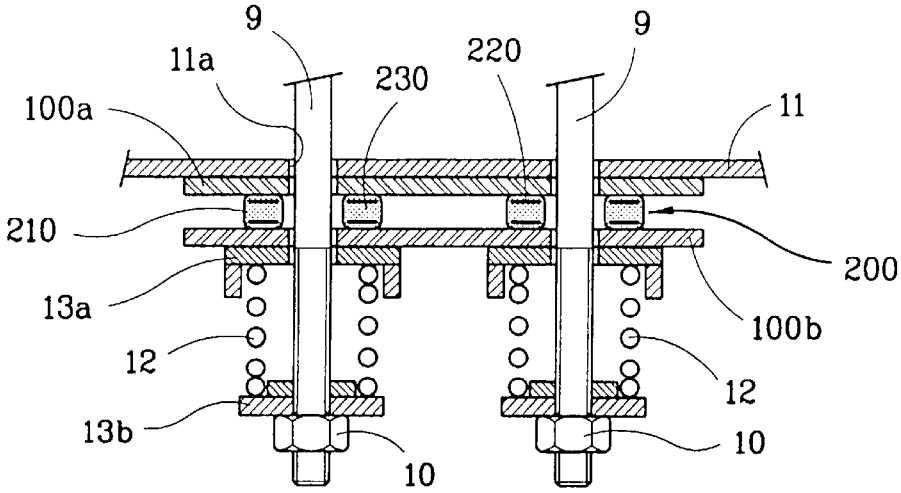
FIG. 4 is a cross-sectional view illustrating a connection structure of a thimble rod in accordance with the present invention.

Meanwhile, FIG. 4 is a cross-sectional view illustrating a connection structure of a thimble rod in accordance with the present invention. A thimble rod 9 provided as a single body at the ends of the main rope 5 is connected to the upper portion of the car 1 and counter weight 4. A structure of the thimble rod 9 is as follows.

An insertion hole 11*a* is formed at the upper portion of the car 1 and counter weight 4 and at a cross head 11. The thimble rod 9 which has spiral lines formed on the outer circumferential surface thereof is inserted into thorough this insertion hole 11*a*.

Next, a spring 12 is installed at the inserted thimble rod 9. This spring 12 is installed at upper and lower spring seats 13*a* and 13*b* through which the thimble rod 9 passes, and fixedly connected to the car 1 and counter weight 4 by connecting a thread 10 to the outer side of the lower spring seat 13*b*.

In addition, upper and lower plates 100*a* and 100*b* through which the thimble rod 9 passes are installed on the lower surface of the cross head 11 and the upper surface of the upper spring seat 13*a* at a predetermined space between them, and a dielectric fluid container 200 is installed at the left and right sides centering at the thimble rod 9 between the upper and lower plates 100*a* and 100*b*.

Herein, the dielectric fluid container 200 is formed in a structure wherein electrodes 220 receiving electric power are included at the inside of a rubber tube 210 and the space between the electrodes 220 is filled with dielectric fluid 230.

The operation of the elevator having an apparatus for reducing vibration of an elevator car in accordance with the present invention thus described is achieved by driving the driving device 3 by control of a control board(not shown) according to the operating command of an operator for thereby lifting and lowering the elevator car 1.

At this time, when the elevator car 1 is driven to be lifted and lowered, the counter weight 4 connected with the elevator car 1 by the main rope 5 is also driven to be lifted and lowered while keeping the balance of the weight of the elevator car 1.

Herein, when the car 1 is driven to be lifted and lowered, the thimble rod control unit 310 controls electric power to be applied to the dielectric fluid container 200 at the car 1 and counter weight 4 according to the position information obtained from the driving control unit 300. Whereupon, the rigidity of the dielectric fluid container 200 varies according to the amount of electric power supplied to the electrodes 200 of the dielectric fluid container 200.

Accordingly, the rigidity of the dielectric fluid container 200 is controlled according to the position of the car 1, so that the node of the vertical vibration mode by the main rope 5 and car 1 can be positioned at the lifting sheave 6 all the time irrespective of the position of the car 1, thereby preventing vibration of the car 1 due to the vertical vibration mode.

For example, in the case that the car 1 is in an upper story portion, the rigidity of the dielectric fluid container 200 at the counter weight 4 is increased to thus increase the rigidity of the spring 12 of the thimble rod 9, and the rigidity of the dielectric fluid container 200 at the car 1 is decreased to thus decrease the rigidity of the spring 12 of the thimble rod 9 at the car 1, thereby making it possible to move the node of the vertical vibration mode of the car 1 to the lifting sheave 6. On the contrary, in the case the car 1 is in an lower story portion, the rigidity of the dielectric fluid container 200 at the counter weight 4 is decreased to thus decrease the rigidity of the spring 12 of the thimble rod 9, and the rigidity of the dielectric fluid container 200 at the car 1 is increased to thus increase the rigidity of the spring 12 of the thimble rod 9 at the car 1, thereby making it impossible to move the node of the vertical vibration mode of the car 1 to the lifting sheave 6

Figure 5:
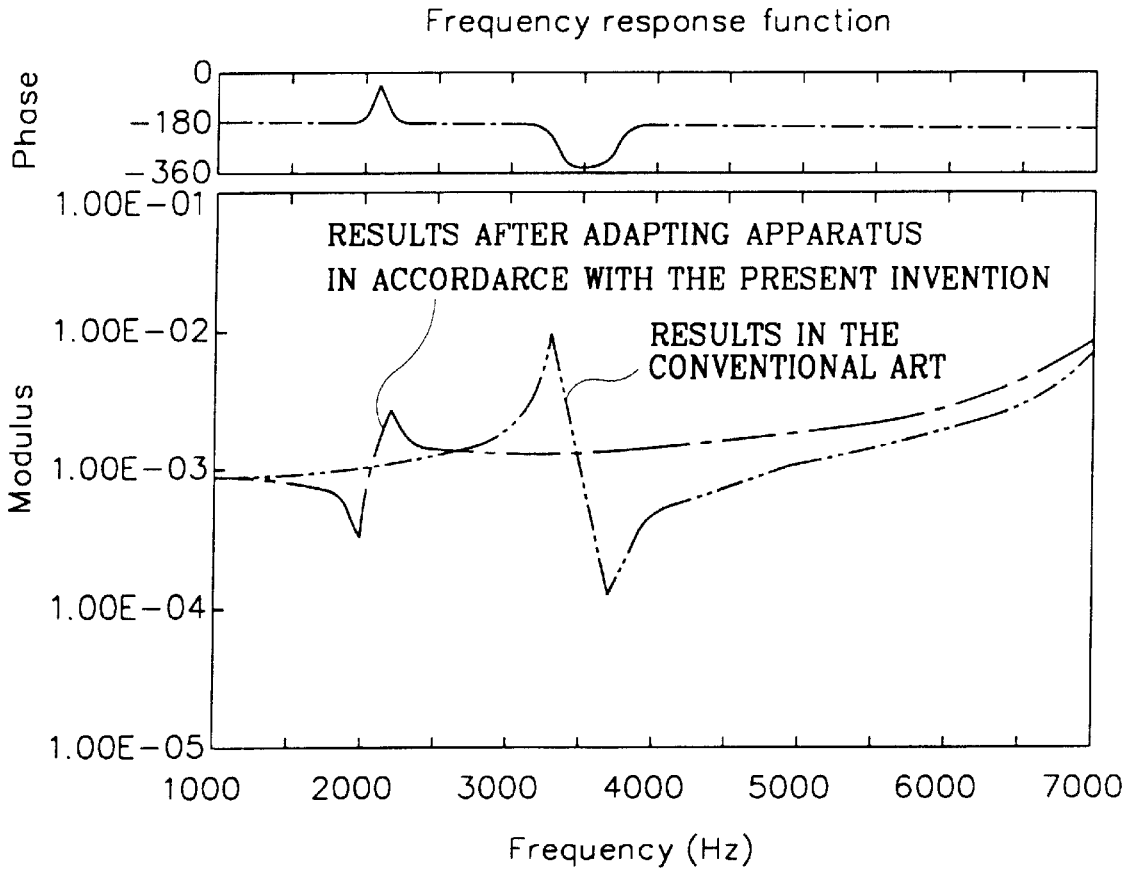
FIG. 5 is a graph illustrating the comparison of simulation results of the acceleration of a car by exciting force of a lifting sheave.

FIG. 5 is a graph illustrating the comparison of simulation results of the acceleration of a car by exciting force of a lifting sheave. As illustrated therein, by comparison between the results of the vibration occurred in an elevator in the conventional art and the results of the vibration occurred when the spring constant of the thimble rod 9 is controlled according to the position of the car 1 in accordance with the embodiment of the present invention, it is known that the vibration of the spring has been remarkably reduced, and accordingly wavering or vibration of the car 1 has also been reduced As described above, in the apparatus for reducing vibration of an elevator in accordance with the present invention, it is possible to prevent vibration of the car by installing the dielectric fluid container whose rigidity varies according to the amount of power supply at the connection portion of the thimble rod at which the spring is elastically installed, thereby improving the level of ride comfort by relieving the passengers' unpleasant feelings due to the vibration occurred during the travelling of the elevator.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. An apparatus for reducing vibration of an elevator car, comprising:

first and second thimble rods respectively fixedly inserted through a cross head of the elevator car and of a counter weight;

a spring installed at the inserted thimble rod;

a dielectric fluid container installed between the cross head and the spring;

a driving control unit for detecting the position of the car;

a thimble rod control unit for controlling the amount of electric power supplied to the dielectric fluid container according to the position information of the car obtained from the driving control unit; and a power supply unit for supplying the dielectric fluid container with electric power whose amount is controlled by the thimble rod control unit.

2. The apparatus of claim 1, wherein the dielectric fluid container is formed by including electrodes receiving electric power at the upper and lower portions in a rubber tube, and filling the space between the electrodes with dielectric fluid.

* * * * *